United States Patent [19]

Roberson

[11] Patent Number: 4,803,944

[45] Date of Patent: Feb. 14, 1989

[54] METHOD AND APPARATUS FOR MAKING A BOAT

[75] Inventor: Robert F. Roberson, San Clemente, Calif.

[73] Assignee: Hot Sports, Inc., Corona del Mar, Calif.

[21] Appl. No.: 93,912

[22] Filed: Sep. 8, 1987

[51] Int. Cl.[4] ..... B63B 3/00; B63B 3/48; B63B 5/24

[52] U.S. Cl. ..... 114/359; 156/253; 156/285; 269/21; 294/65

[58] Field of Search ..... 114/85, 355, 356, 357, 114/358, 359, 65 R; 294/65; 269/21; 156/285, 382, 253

[56] References Cited

U.S. PATENT DOCUMENTS

| | | | |
|---|---|---|---|
| 2,509,494 | 5/1950 | Gruenwald | 156/253 X |
| 4,131,962 | 1/1979 | Vernon | 114/357 |
| 4,527,783 | 7/1985 | Collora et al. | 269/21 |

*Primary Examiner*—Sherman D. Basinger

*Attorney, Agent, or Firm*—Morland C. Fischer

[57] ABSTRACT

A method and apparatus for making a boat, or similar vessel, having a hull section to be bonded to a deck section. Pairs of pivotal arms are located adjacent the hull and adapted to be rotated in a first direction towards each of the sides thereof. A plurality of vacuum assemblies, each assembly including a vacuum cup, are attached to the pivotal arms and movable therewith toward the sides of the hull. A vacuum line is connected in common with each of the vacuum cups by which to establish a vacuum for causing the cups to become firmly attached to opposite sides of the hull. When the pivotal arms are rotated in a second, opposite direction, the hull is correspondingly pulled into contact with a peripheral lip of the deck. A layer of glue is deposited around the peripheral lip of the deck, so that the deck and hull sections will be bonded together to form a complete hull. Holes are formed through the hull into which the glue may ooze for establishing an additional mechanical bond and thereby enhancing the integrity of the connection between the hull and deck sections.

16 Claims, 4 Drawing Sheets

METHOD AND APPARATUS FOR MAKING A BOAT

BACKGROUND OF THE INVENTION

1. Field of the Invention

This invention relates to an improved method and unique apparatus for making a hollow vessel, such as a boat, or the like, which is formed by the bonding together of deck and hull sections to form a complete hull assembly.

2. Prior Art

It is know to form the complete hull assembly of a boat by gluing the deck and hull sections together. Typically, peripheral edges of the deck and hyll are held together by a layer of glue located therebetween. The resulting bond which is formed to secure the deck and hull together is sometimes known as a substrate bond. However, such a substrate bond has also been known to adversely effect the performance and appearance of the boat with which it is associated.

More particularly, the glue seam formed between the deck and hull sections may split. That is, voids and cracks often occur which tend to weaken the bond between the hull and deck. Therefore, a conventional substrate bond, in and of itself, may not be sufficient to adequately retain the deck and hull sections together, particularly when the boat is exposed to large temperature variations and extreme mechanical forces. Moreover, the relatively large amount of glue that is used in a substrate bond to secure the deck and hull together adds to the overall weight of the boat and reduces the maximum possible speed. What is more, the glue seam created at the interface between the deck and hull sections commonly extends beyond the exterior of the boat. Such a glue seam represents a waste of glue and adversely impacts the asthetic appearance of the boat. In addition, the glue seam increases the drag exerted by the water upon the boat, whereby to decrease operating speed. Consequently, it is not uncommon to require an additional machining process to remove the obtrusive glue seam from the exterior of the hull.

SUMMARY OF THE INVENTION

Briefly, and in general terms, a method and apparatus are disclosed for making a hollow vessel, such as a boat, or the like, having a hull section to be connected to a deck section. The apparatus includes a supporting and gluing jig comprising pivotal arms which are positioned adjacent the port and starboard sides of the hull. A plurality of vacuum assemblies, each assembly including a vacuum cup, are connected to the pivotal arms in an evenly spaced relationship therealong. Each of the vacuum cups communicates with a vacuum pump by way of a common vacuum hose. The vacuum cups are moved into contact with the hull when the pivotal arms are rotated in a first direction towards the port and starboard sides thereof. The vacuum pump creates a vacuum head at each of the vacuum cups for firmly attaching the cups to the hull. In this manner, the hull may initially be suspended above the deck.

A layer of glue is deposited around a peripheral lip of the deck and the hull is then lowered to a position adjacent the deck. The pivotal arms are rotated in a second direction towards the deck for correspondingly pulling the hull, to which the vacuum cups are attached, into contact with the deck, such that the layer of glue is sandwiched therebetween. By drilling a series of holes into the hull into which the glue may ooze, both mechanical and substrate bonds are formed when the glue dries and hardens to permanently secure the deck and hull sections together and thereby form a complete hull.

DESCRIPTION OF THE PREFERRED EMBODIMENT

Figure 1:
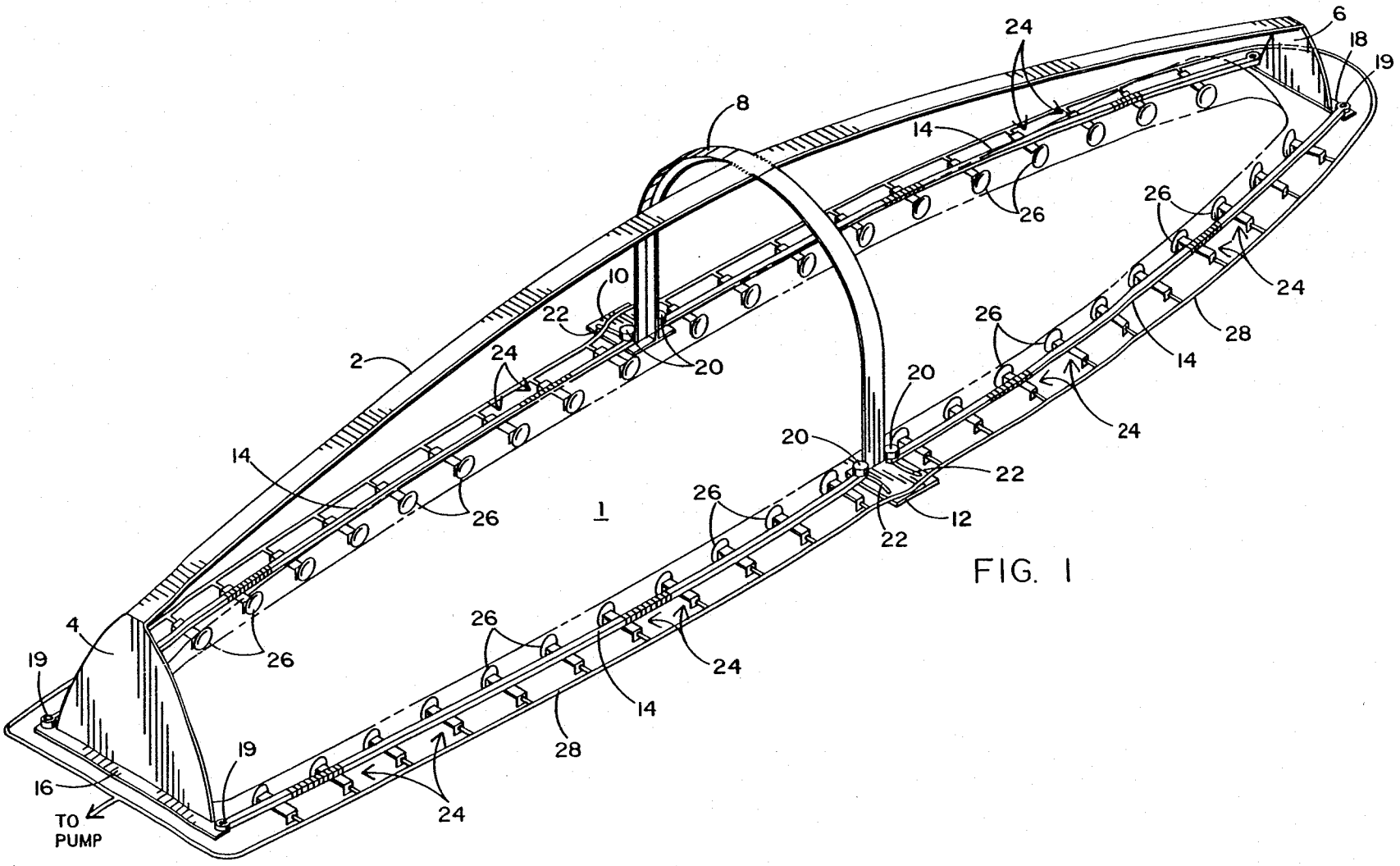
FIG. 1 is a perspective view showing the supporting and gluing jig which forms a part of the present invention.

The method and apparatus for making a boat is now described while referring to the drawings, where, in FIG. 1, the hollow, fiberglass hull of a boat is shown (in phantom) in an inverted position suspended by a supporting and gluing jig. The final boat assembly may include a single hull (such as for a kayak) or a pair of hulls (such as for a catamaran). However, for purposes of illustration, the manufacture of a single hull 1, only, will be disclosed regardless of the number of hulls that are ultimately required to complete the particular boat assembly. Needless to say, the presently disclosed method and apparatus have particular application for the manufacture of any vessel which is characterized by the attachment of a deck to a hull including, but not limited to, a canoe, kayak, rowing shell, sailboat, catamaran, motor boat, and the like.

The supporting and gluing jig comprises an arcuately shaped, longitudinally extending truss 2 which is connected (e.g. welded) at one end thereof to a vertically extending stern plate 4 and at the opposite end to a vertically extending bow plate 6. The bow and stern plates 6 and 4 may also be interconnected with and slideable along respective vertically extending frame bars (not shown) which guide the supporting and gluing jig during a raising or lowering of the hull. An inverted, U-shaped, laterally extending yoke 8 is connected (e.g. welded) at one end thereof to a horizontally projecting yoke connecting plate 10 adjacent the port side of the hull 1 and at the opposite end to a yoke connecting plate 12 adjacent the starboard side of the hull 1. The laterally extending yoke 8 and the longitudinally extending truss 2 are connected (e.g. welded) to one another at their respective mid-points. Each of the aforementioned truss 2, yoke 8 and plates 4, 6, 10 and 12 is preferably fabricated from steel or any other suitable structurally sound metal.

Oppositely disposed pairs of pivotal arms 14 are positioned around the port and starboard sides of the hull 1. More particularly, a first pair of pivotal arms 14 are positioned adjacent to but spaced from the starboard and port sides of hull 1 between a first horizontal base plate 16 (which extends across the stern of the hull) and a first end of a respective yoke connecting plate 10 or 12. A second pair of pivotal arms 14 is also located adjacent to but spaced from the starboard and port sides of hull 1 between a second horizontal base plate 18 (which extends across the bow of the hull) and the opposite end of a respective yoke connecting plate 10 or 12. Each arm 14 comprises a metallic bar, one end of which is pivotally connected to a respective base plate 16 or 18 at the stern or bow of hull 1 by means of an integral hollow sleeve 19. The hollow sleeve 19 of each arm 14 is adapted to receive therewithin and rotate around a cylindrical gudgeon (not shown) which projects vertically from base plates 16 and 18. The opposite end of each arm 14 is detachably connected to an end of a respective yoke connecting plate 10 or 12 by means of a bolt 20 (and nut), or the like. The bolts 20 are received through respective arms 14 and arcuate slots 22 formed at opposite ends of the yoke connecting plates 10 and 12. In this manner, and as will be described in greater detail hereinafter when referring to FIG. 2, each of the arms 14 can be selectively rotated, indpendently of the other arms, relative to an adjacent side of hull 1 by sliding a bolt 20 along its respective slot 22.

Figure 3:
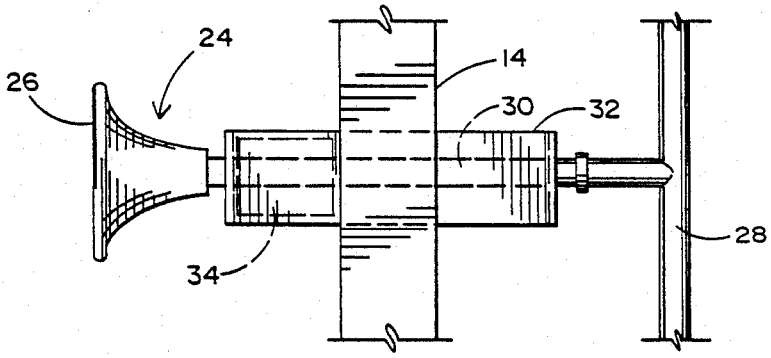
FIG. 3 is a detailed illustration of a vacuum assembly of the supporting and gluing jig of FIG. 1.
Figure 4:
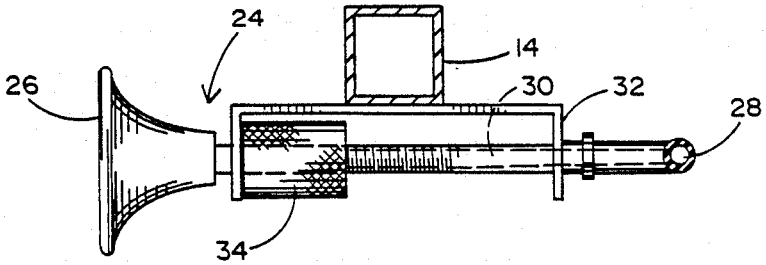
FIG. 4 is a side view of the vacuum assembly of FIG. 3.

Referring concurrently to FIGS. 1, 3 and 4 of the drawings, each of the pivotal arms 14 has a plurality of vacuum assemblies 24 projecting toward the hull 1 at evenly spaced intervals therealong. As is best shown in FIGS. 3 and 4, each vacuum assembly 24 includes a flexible vacuum cup 26. The vacuum cups 26 of the vacuum assemblies 24 of the pivotal arms 14 communicate with a vacuum pump by way of a common vacuum hose 28. By way of example, a suitable pump (best depicted in FIG. 1) which may be placed into fluid communication with the vacuum cups 26 of vacuum assemblies 24 via common hose 28 is Model No. M63 manufactured by PIAB of Sweden.

As is also best shown in FIGS. 3 and 4, each vacuum assembly 24 includes an (e.g. aluminum) screw-threaded vacuum tube 30 which is interconnected between a vacuum cup 26 and the vacuum hose 28. Each vacuum assembly 24 also includes a support channel 32 which is connected (e.g. welded) to the underside of one of the pivotal support arms 14. The vacuum tube 30 of vacuum assembly 24 extends through opposite ends of and is retained by support channel 32, so that the location and movement of each vacuum cup 26 relative to the hull 1 can be controlled by the corresponding movement of its associated pivotal arm 14 (in a manner to be described when referring to FIG. 2).

A hollow, internally threaded adjustment knob 34 surrounds the screw threaded vacuum tube 30 of vacuum assembly 24 at a location between the opposite ends of support channel 32. Adjustment knob 34 is adapted to be manually rotated around vacuum tube 30 to cause a corresponding linear movement of the tube 30 and the vacuum cup 26 which is connected at one end thereof. That is to say, by rotating adjustment knob 34 in a first direction around tube 30, the vacuum cup 26 is advanced in a corresponding linear direction towards the hull. By rotating adjustment knob 34 in the opposite direction, the vacuum cup 26 is retracted in a corresponding linear direction away from the hull. An adjustment knob 34 of the vacuum assembly 24 may be selectively rotated when it is desirable to accurately control and precisely position an associated vacuum cup 26 relative to the port or starboard side of the hull.

Figure 2:
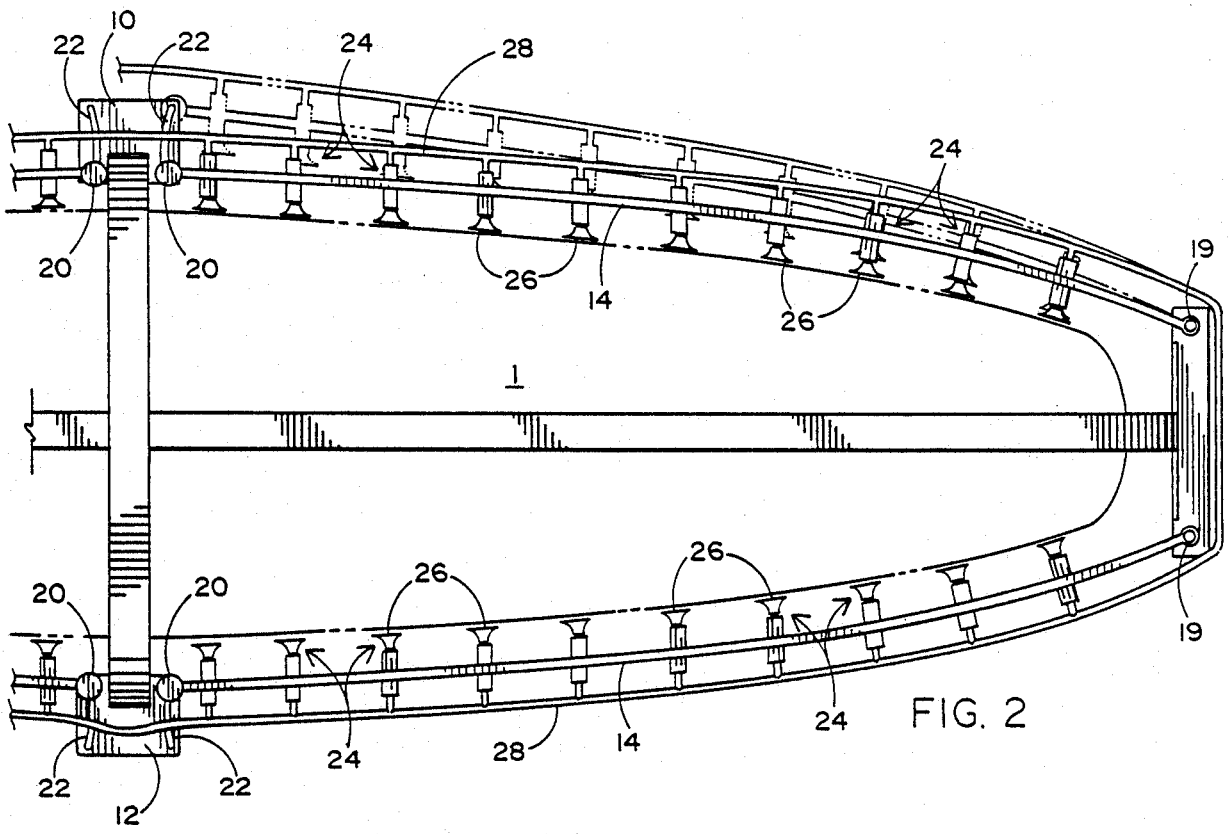
FIG. 2 is a partial top view of the supporting and gluing jig of FIG. 1.

The manner by which the pivotal arms 14 of the supporting and gluing jig (of FIG. 1) control the movement of the vacuum assemblies 24 and the positions of the vacuum cups 26 thereof relative to the hull 1 of the boat to be assembled is now described while referring to FIG. 2 of the drawings. Initially, the pivotal arms 14 are rotated at their respective hollow sleeves 19 in a radially inward direction from spaced positions (shown in phantom) relative to the hull 1 to positions immediately adjacent the hull, such that the vacuum cups 26 of each of the vacuum assemblies 24 are moved into contact with the port and starboard sides of the hull. That is, the bolts 20 are slid through the respective slots 22 in yoke connecting plates 10 and 12 in order to rotate pivotal arms 14 and the plurality of vacuum assemblies 24 toward and into engagement with the hull 1. The bolts 20 and their associated nuts (not shown) are then tightened down against the yoke connecting plates 10 and 12 to secure the positions of the vacuum cups 26 against the hull 1. Next, certain adjustment knobs (designated 34 in FIGS. 3 and 4) may be selectively rotated depending upon the configuration of the hull to accurately and precisely adjust the position of the vacuum cups 26 by further advancing such vacuum cups towards the hull.

Once all of the vacuum cups 26 have been properly moved into engagement with the hull, the vacuum pump (best depicted in FIG. 1) is actuated, whereby to evacuate the vacuum hose 28 and establish a vacuum head at each of the vacuum cups 26. So long as the vacuum pump remains actuated, the vacuum cups 26 will be firmly attached to the port and starboard sides of the hull 1 at evenly spaced intervals therealong.

Figure 5:
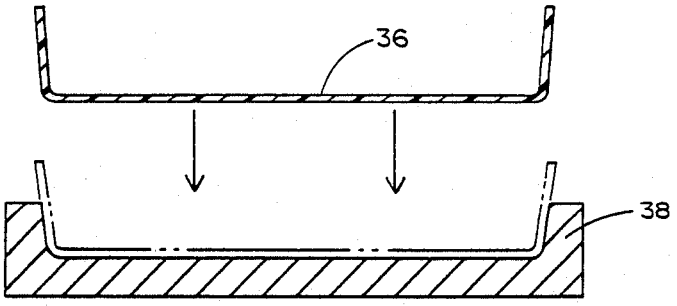
FIGS. 5–10 illustrate the steps of the present invention for making a boat, or similar vessel.

The method for making a boat (i.e. for connecting the deck and hull sections together) is now described while referring to FIGS. 5–10 of the drawings. In FIG. 5, fiberglass deck 36 is received (in an inverted position) within a deck fixture 38 (the deck being shown in phantom when received within and supported by deck fixture 38). Deck fixture 38 is preferably fabricated from wood or fiberglass and has a configuration including upwardly extending ends which correspond to the shape of the deck 36.

Figure 6:
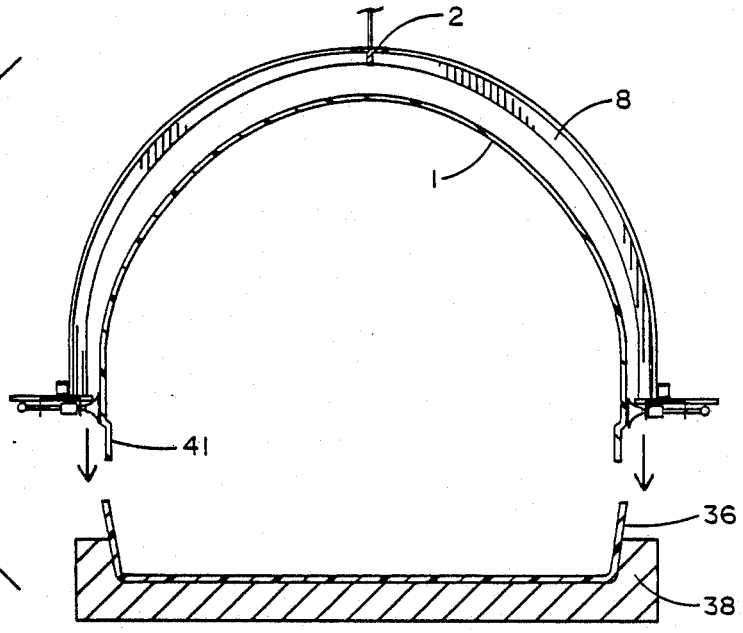

In FIG. 6, the inverted hull 1 (shown in the suspended position in FIG. 1) is lowered towards the deck fixture 38 and the deck 36 resting therein. By way of example, an air actuated ram (not shown) may be interfaced with the truss 2 and yoke 8 of the supporting and gluing jig by means of cables, or the like (also not shown), whereby to control the movement of the suspended hull towards the deck 36. However, prior to the lowering of hull 1 towards deck 36, a layer of glue (designated 40 in FIG. 8) is deposited along the inner peripheral edge of deck 36. The glue 40 may be any commercially available glue or other suitable adhesive for bonding together the fiberglass deck and hull such as, for example, that consisting of a laminating resin, glass fiber, glass bubbles, white coloring plus a catalyst for hardening.

Figure 7:
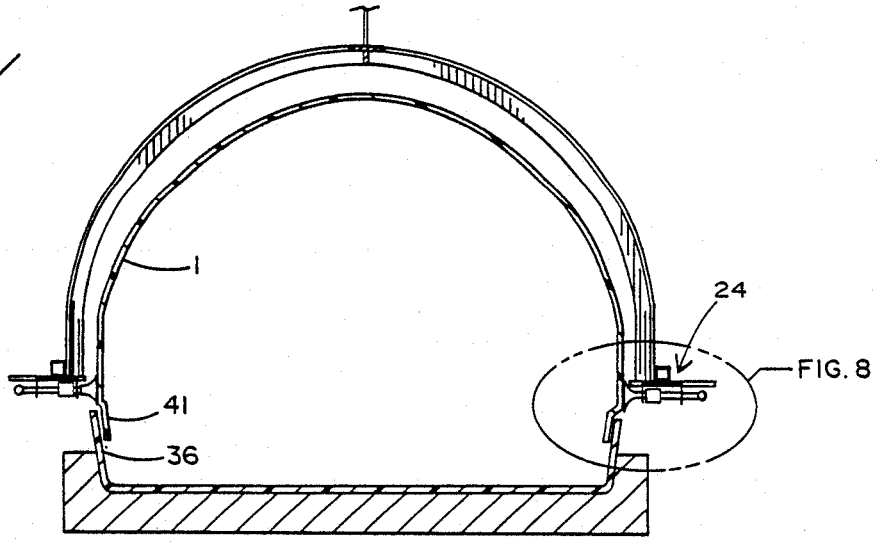
Figure 8:
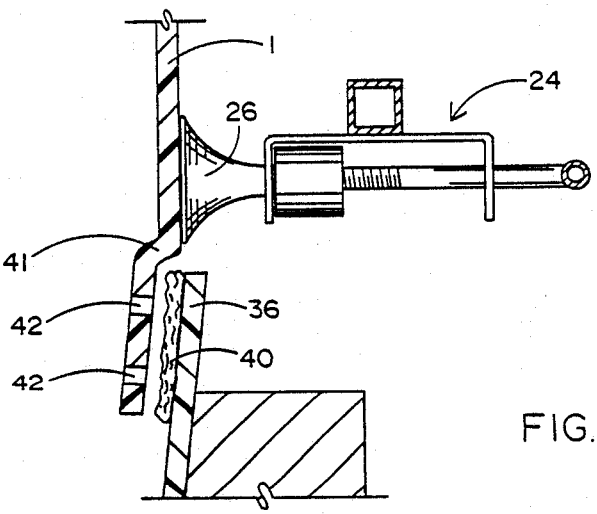

In FIGS. 7 and 8, the inverted hull is shown in the lowered position such that a recessed peripheral lip 41 thereof is located adjacent to and spaced from the inner peripheral edge of deck 36 to which the layer of glue 40 has been applied. Prior to the lowering of the hull 1 towards the deck 36, a plurality of holes 42 are formed (drilled) through the peripheral lip 41. As will soon be explained, the holes 41 provide an anchor by which to mechanically bond the deck 36 and hull 1 together.

Figure 9:
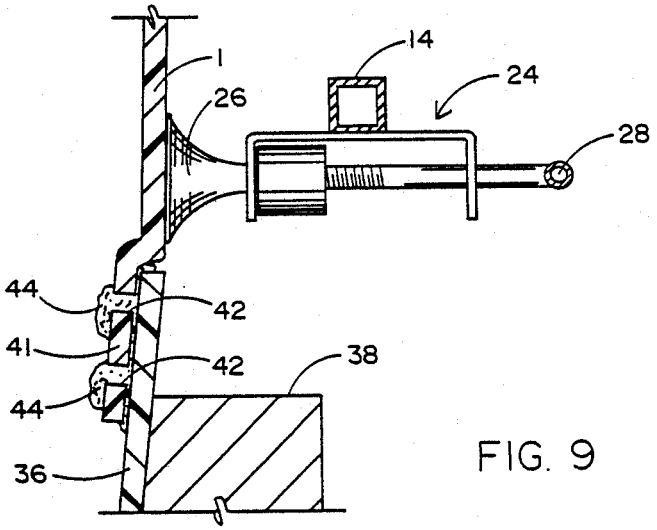
Figure 10:
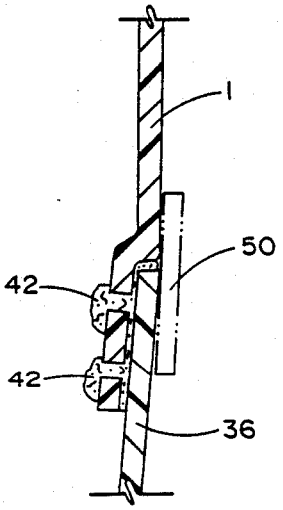

In FIG. 9, the recessed peripheral lip 41 of the hull 1 is pulled into engagement with the inner peripheral edge of the deck 36, such that the layer of glue 40 is sandwiched therebetween. More particularly, and also referring once again to FIG. 2, with the vacuum cups 26 of vacuum asseemblies 24 remaining firmly attached to the port and starboard sides of the hull, each of the pivotal arms 14 is rotated at its respective sleeve 19 in a radially outward direction towards the deck 36. That is, the bolts 20 are slid to opposite ends of the slots 22 formed in yoke connecting plates 10 and 12. The bolts 20 and their associated nuts are then tightened down against the plates 10 and 12 to secure pivotal arms 14 in the just rotated positions. Inasmuch as the vacuum cups 26 are firmly attached to the hull 1, the rotation of the arms 14 generates a uniform pulling force for correspondingly moving the recessed peripheral lip 41 of hull 1 towards and into contact with the inner peripheral edge of deck 36.

As is best shown in FIG. 9, the rotation of the pivotal arms 14 and the movement of the recessed peripheral lip 41 of hull 1 against the deck 36 forces the glue to ooze through the holes 42 and pass around any glass fibers remaining in such holes. After the passage of sufficient time, the glue will harden to form button-like heads 44 (at a location which corresponds to the interior of the completed hull). Each button head 44 provides a mechanical bond, in the nature of a rivet, to attach the deck 36 to the hull 1. This mechanical bond, coupled with the substrate bond provided by the original layer of glue (designated 40 in FIG. 8) between the deck 36 and hull 1, acts to permanently secure the deck and hull together to form a complete hull assembly. After the glue has dried and hardened, the vacuum pump is de-energized and the vacuum heads established at vacuum cups 26 through vacuum hose 28 are terminated. The vacuum assemblies 24 and the respective vacuum cups 26 thereof may, therefore, be detached from the completed hull.

The completed hull may now be removed from the deck fixture 38 and relocated to a storage or other work area. However, it may first be desirable to hide the glue seam created at the interface of the deck 36 and hull 1. Accordingly, and referring to FIG. 10, a decal or other decorative strip (designated 50 and shown in phantom) may be applied around the exterior of the completed hull along such interface. In this manner, the asthetic appeal of the completed hull can be enhanced while avoiding the necessity of machining the hull to remove any external glue seam.

It will be apparent that while a preferred embodiment of the invention has been shown and described, various modifications and changes may be made without departing from the true spirit and scope of the invention. For example, although the presently described method and apparatus have been indicated as having particular application to the making of a boat, it should be recognized that the teachings of this invention are also applicable to the manufacture of other hollow vessels, such as, for example, a drum, tank, aircraft fuseilage, and the like.

Having thus set forth a preferred embodiment of the present invention, what is claimed is:

1. Apparatus for making a vessel having a hull with opposing sides, said hull to be connected to a deck, said apparatus comprising:

movable arm means including at least one arm located adjacent and movable towards a respective side of said hull;

vacuum assembly means attached to each of each movable arms and movable therewith for engaging the sides of said hull when said arms are moved towards said sides;

means communicating with said vacuum assembly means for creating a vacuum and for thereby causing said vacuum assembly means to become attached to the sides of the hull for positioning said hull relative to said deck; and pivot means located at a first end of each of said arms to that said arms can be rotated towards said respective sides of said hull for correspondingly moving said vacuum assembly means into engagement with said sides.

2. The apparatus recited in claim 1, said apparatus further comprising a plate located adjacent each side of said hull and having at least one slot formed therethrough, the second ends of said movable arms being slideable along respective slots for causing said arms to be rotated towards the sides of said hull.

3. The apparatus recited in claim 1, further comprising a plurality of said vacuum assemblies attached to and spaced from one another along each of said movable arms for engaging said hull when said arms are rotated thereto.

4. The apparatus recited in claim 3, wherein each of said vacuum assemblies includes a vacuum cup to be moved into engagement with and to become attached to a side of said hull when the movable arm to which said vacuum cup is attached rotates towards said hull.

5. The apparatus recited in claim 4, further comprising a vacuum pump and a vacuum hose interconnected between said pump and the vacuum cups of each of said plurality of vacuum assemblies, said pump creating a vacuum via said hose for causing each of said vacuum cups to become attached to the sides of said hull.

6. The apparatus recited in claim 1, further comprising support means interconnected with each of said movable arms for suspending said hull above said deck after said vacuum assembly means have been moved into engagement with the sides of said hull.

7. Apparatus by which to make a hollow vessel comprising the connection together of first and second complementary body members, said apparatus comprising:

a plurality of movable arms located adjacent the sides of a first of said body members;

a plurality of vacuum cups connected to said plurality of movable arms and attached to the sides of said first body member;

means for positioning said first body member relative to the second of said body members so that respective peripheral edges of said first and second body members are located adjacent to the spaced from one another;

adhesive means positioned around the peripheral edge of at least said second body member; and means for moving said plurality of movable arms and the vacuum cups connected thereto towards said second body member to thereby pull the peripheral edge of said first body member into contact with the peripheral edge of said second body with said adhesive means being sandwiched therebetween.

8. A method for connecting a hull to a deck for forming a complete hull assembly, said method comprising the steps of:

positioning said hull relative to said deck such that peripheral edges of said deck and hull are adjacent to and spaced from one another;

forming a plurality of holes through at least one of said hull or said deck along the peripheral edge thereof;

depositing an adhesive to at least the other one of said hull or said deck along the peripheral edge thereof; and applying a pulling force to at least one of said hull or said deck for moving the peripheral edges of said hull and deck into contact with one another so that the adhesive will be sandwiched therebetween and forced through the holes in said hull or said deck for forming both substrate and mechanical bonds and thereby connecting said hull and deck together.

9. The method recited in claim 8, including the additional step of positioning said hull relative to said deck by suspending said hull above said deck.

10. The method recited in claim 8, including the additional step of attaching a plurality of vacuum cups to the sides of said hull for positioning said hull relative to said deck.

11. The method recited in claim 10, including the additional steps of:

attaching said plurality of vacuum cups to pivotal arms and locating said arm adjacent the sides of said hull;

rotating said pivotal arms in a first direction towards said hull for moving the respective vacuum cups thereof into engagement with the sides of said hull; and creating a vacuum for attaching said vacuum cups to the sides of said hull.

12. The method recited in claim 11, including the additional step of interconnecting a vacuum hose between a vacuum pump and said plurality of vacuum cups for creating the vacuum by which to attach said vacuum cups to the sides of said hull.

13. The method recited in claim 11, including the additional step of rotating said pivotal arms in a second direction towards said deck after said vacuum cups have been attached to said hull for applying said pulling force to said hull and thereby moving the peripheral edge of said hull into contact with the peripheral edge of said deck with said adhesive being sandwiched therebetween and forced through said holes.

14. A method for making a hollow vessel comprising the connecting together of first and second complementary body members, said method including the steps of:

attaching a plurality of vacuum cups to the sides of a first of said body members;

positioning said first body member relative to the second of said body members, such that respective peripheral edges of said first and second body members are located adjacent to and spaced from one another;

depositing an adhesive around the peripheral edge of said second body member; and moving said plurality of vacuum cups attached to said first body member towards said second body member and thereby pulling the peripheral edge of said first body member into contact with the peripheral edge of said second body member with the adhesive being sandwiched therebetween.

15. The method recited in claim 14, including the additional steps of connecting said plurality of vacuum cups to a plurality of pivotal arms located adjacent the sides of said first body member and rotating said pivotal arms for moving said plurality of vacuum cups towards said second body member and thereby pulling the peripheral edge of said first body member into contact with the peripheral edge of said second body member.

16. The method recited in claim 14, including the additional step of forming a plurality of holes around the peripheral edge of said first body member so that adhesive will be forced through said holes when the peripheral edges of said first and second body members are moved into contact with one another.

* * * * *